US010092990B2

(12) United States Patent
Jung et al.

(10) Patent No.: US 10,092,990 B2
(45) Date of Patent: Oct. 9, 2018

(54) EDGING PAD HAVING DIFFERENT ADHESIVE ZONES

(71) Applicant: Rodenstock GmbH, Munich (DE)

(72) Inventors: Stefan Jung, Stavanger (NO); Michael Vögt, Gilching (DE)

(73) Assignee: Rodenstock GmbH, Munich (DE)

( * ) Notice: Subject to any disclaimer, the term of this patent is extended or adjusted under 35 U.S.C. 154(b) by 61 days.

(21) Appl. No.: 15/327,051

(22) PCT Filed: May 21, 2015

(86) PCT No.: PCT/EP2015/001040
§ 371 (c)(1),
(2) Date: Jan. 18, 2017

(87) PCT Pub. No.: WO2016/023602
PCT Pub. Date: Feb. 18, 2016

(65) Prior Publication Data

US 2017/0173753 A1 Jun. 22, 2017

(30) Foreign Application Priority Data

Aug. 13, 2014 (DE) ..... 10 2014 012 025

(51) Int. Cl.
*B24B 13/00* (2006.01)
*B24B 13/005* (2006.01)
*B24B 9/14* (2006.01)

(52) U.S. Cl.
CPC ..... *B24B 13/005* (2013.01); *B24B 9/146* (2013.01); *B24B 9/14* (2013.01); *B24B 13/0052* (2013.01); *B24B 13/0057* (2013.01)

(58) Field of Classification Search
CPC ..... B24B 13/005; B24B 9/005; B24B 9/146; B24B 9/14

(Continued)

(56) References Cited

U.S. PATENT DOCUMENTS 2,224,168 A * 12/1940 Tillyer ..... B24B 13/005 118/500
2,607,711 A * 8/1952 Hendricks ..... C09J 7/201 428/41.5

(Continued)

FOREIGN PATENT DOCUMENTS

| | | | |
|---|---|---|---|
| EP | 0615814 | A1 | 9/1994 |
| EP | 1935565 | A1 | 6/2008 |
| WO | 2005120774 | A1 | 12/2005 |

OTHER PUBLICATIONS

Patent Cooperation Treaty (PCT), International Search Report and Written Opinion for Application PCT/EP2015/001040 filed May 21, 2015, dated Nov. 4, 2015, International Searching Authority, EP.

*Primary Examiner* — George Nguyen
(74) *Attorney, Agent, or Firm* — McDonald Hopkins LLC

(57) ABSTRACT

The invention relates to an edging pad for releasably connecting a material blank that is to be edged to a holder, wherein the edging pad has a polymeric carrier layer and adhesive coatings which are applied to both sides of the polymeric carrier layer, wherein one side of the polymeric carrier layer, which is to be connected to the holder, has an adhesive coating formed of a first adhesive, and the other side of the polymeric carrier layer, which is to be connected to the material blank, has an adhesive coating formed of a second and a third adhesive which are different from one another, such that the second adhesive provides adhesiveness to the material blank and the third adhesive is an adhesive which limits twisting and slippage of the polymeric carrier layer relative to the material blank, wherein the second adhesive and the third adhesive are applied to the other side of the polymeric carrier layer in separate regions.

12 Claims, 2 Drawing Sheets

(58) Field of Classification Search
USPC ..... 451/364, 384, 390, 41, 42, 43, 44, 460; 156/290, 291, 314
See application file for complete search history.

(56) References Cited

U.S. PATENT DOCUMENTS

| | | | | | |
|---|---|---|---|---|---|
| 3,197,326 | A * | 7/1965 | Webber | C09J 7/50 | 428/353 |
| 3,490,182 | A * | 1/1970 | Lanman | B24B 13/005 | 451/390 |
| 4,221,083 | A * | 9/1980 | Carroll | B24B 13/00 | 451/42 |
| 4,530,139 | A * | 7/1985 | Miller | H03H 3/04 | 29/25.35 |
| 5,384,988 | A * | 1/1995 | Hernandez | B24B 13/01 | 451/42 |
| 2004/0060675 | A1* | 4/2004 | Archer | B31F 1/12 | 162/111 |
| 2007/0105490 | A1 | 5/2007 | Achy et al. | | |
| 2008/0274672 | A1* | 11/2008 | Cole | B24B 9/146 | 451/41 |
| 2010/0178496 | A1* | 7/2010 | Masuda | C09J 183/04 | 428/347 |
| 2015/0349311 | A1* | 12/2015 | Sawada | H01M 4/139 | 156/60 |

* cited by examiner

EDGING PAD HAVING DIFFERENT ADHESIVE ZONES

This application is a 35 U.S.C. 371 national stage filing and claims priority to PCT Application No. PCT/EP2015/001040, entitled "GRINDING PAD HAVING DIFFERENT ADHESION ZONES," filed May 21, 2015, which claims the benefit of German Application No. 102014012025.2, entitled "EINSCHLEIFPAD MIT UNTERSCHIEDLICHEN KLEBEZONEN" filed Aug. 13, 2014, both of which are incorporated by reference herein in their entirety.

The present invention relates to an edging pad for releasably connecting a material blank that is to be edged to a holder.

In the field of optical lenses, in particular optical lenses for visual aids (spectacle lenses), it is usually necessary to grind the blank shape of the optical lenses at the edges after they have been produced in order, for example, to adapt them to spectacle frames of different shapes. This grinding operation is referred to as edging.

Such edging is carried out using so-called edge-machining or edging devices, which are frequently automated. Examples of such devices are the model E.3 from Weco (obtainable from Buchmann Deutschland GmbH, Neuss, Germany) and the models SE9090, ME 1200 and LE 9000 from Nidek Co., Ltd., Japan. In order to hold the optical lens firmly inside the edging device so that the optical lens can be machined using a grinding device, the optical lens is blocked before it is machined. In blocking, the optical lens is releasably connected to a blocker element so that an optical lens-blocker element unit is obtained, which is then inserted into the edging device. The blocker element is usually produced from plastics material and is connected to a surface of the optical lens by way of a so-called edging pad.

Edging pads conventionally consist of a polymeric carrier layer which is coated on both sides with adhesives, so that a releasable connection both to the blocker element and to the optical lens can be produced. Since the blocker element and the optical lens are made of different materials, different adhesives are used for bonding the blocker element and the optical lens, which adhesives are optimized for adhesion to the blocker element and to the optical lens, respectively.

On the one hand, it is important for the edging pad to provide sufficient adhesion for edging between the edging pad and the optical lens or the blocker element, so that they do not become detached from the edging pad during transport to the edging device and during automatic handling in the edging device as well as during the grinding operation itself. On the other hand, it is necessary to prevent twisting (torsion) and slippage (on the axis) of the optical lens in relation to the edging pad owing to the shear forces that occur during the edging operation, since edging errors may otherwise occur, which lead to increased formation of rejects.

Modern optical lenses having a reflective or anti-reflective coating, which are used as spectacle lenses, are conventionally coated with silylated perfluorinated polyether compounds. A very smooth surface is thus formed on the optical lenses, which provides very high slidability.

When such coated optical lenses are to be edged, the problem of twisting and slippage of the optical lens in relation to the edging pad in particular occurs on account of this high slidability.

Hitherto, so-called anti-slip films have been inserted between a conventional edging pad and the optical lens as a measure against such twisting. The anti-slip films are larger than the edging pad in terms of area and serve to improve adhesion. However, such films have the disadvantage that, owing to an additional shear surface, they provide a further possibility for twisting and slippage between the edging pad and the lens surface.

Edging pads which can be used for coated optical lenses are also known and described, for example, in U.S. 2008/0274672 A1.

U.S. 2008/0274672 A1 discloses an ophthalmic blocking pad which has a foam layer, a film layer which is arranged on the foam layer and is in direct contact with the foam layer, the film layer having a tensile strength of at least approximately 172 MPa, and an adhesive layer which is arranged on the film layer.

However, if the adhesive surfaces on the lens side are optimized for better adhesion, as described in U.S. 2008/0274672 A1, this always impairs the torsion properties.

Accordingly, it is an object of the present invention to overcome the above-described disadvantages of edging pads for coated optical lenses. In particular, it is an object of the present invention to provide edging pads for the edging of material blanks having very smooth surfaces, which have very high slidability, in particular of coated optical lenses.

The object is achieved by the subject-matter of claim 1. Advantageous embodiments are the subject-matter of the dependent claims.

The present invention relates in particular to an edging pad for releasably connecting a material blank that is to be edged to a holder, wherein the edging pad has a polymeric carrier layer and adhesive coatings which are applied to both sides of the polymeric carrier layer, wherein one side of the polymeric carrier layer, which is to be connected to the holder, has an adhesive coating formed of a first adhesive, and the other side of the polymeric carrier layer, which is to be connected to the material blank, has an adhesive coating formed of a second and a third adhesive which are different from one another, such that the second adhesive provides adhesiveness to the material blank and the third adhesive is an adhesive which limits twisting of the polymeric carrier layer relative to the material blank, wherein the second adhesive and the third adhesive are applied to the other side of the polymeric carrier layer in separate regions.

It has been found, surprisingly, that the problems of known edging pads can be eliminated by the provision of an edging pad in which there is provided on the side of the polymeric carrier layer that is to be connected to the material blank, such as, for example, a coated optical lens, an adhesive coating formed of a second and a third adhesive which are different from one another, such that the second adhesive provides adhesiveness to the material blank and the third adhesive is an adhesive which limits twisting and slippage of the polymeric carrier layer relative to the material blank, wherein the second adhesive and the third adhesive are applied to the other side of the polymeric carrier layer in separate regions.

By means of the edging pad according to the invention it is thus possible to edge material blanks having very smooth surfaces, which have very high slidability, in particular coated optical lenses, in edging devices in the blocked state without rejects being produced as a result of twisting of the material blanks in relation to the edging pad.

There can be used as the above-mentioned first adhesive any adhesive which is conventionally known to the person skilled in the art for applying a blocker element to an edging pad.

Also known to the person skilled in the art are adhesives which can be used as the second adhesive and the third adhesive, whereby the second adhesive must in particular provide adhesiveness to the material blank and the third adhesive must be capable of limiting, preferably preventing, twisting of the polymeric carrier layer relative to the material blank.

The first, the second and the third adhesive are selected independently preferably from pressure-sensitive adhesives which in each case provide the suitable adhesion properties, that is to say suitable adhesiveness and a suitable ability to prevent torsion.

The pressure-sensitive adhesives are preferably selected from copolymers which are reaction products of the polymerization of at least one A monomer and at least one B monomer, wherein the A monomer is a polymerizable monomer which comprises an acrylate or methacrylate ester of a non-tertiary alcohol or of a mixture of non-tertiary alcohols, wherein the alcohols have from 1 to 14 carbon atoms and preferably on average from 4 to 12 carbon atoms. The B monomer is an ethylenically unsaturated compound and can preferably be acrylic acid, methacrylic acid, itaconic acid, acrylamide, methacrylamide, acrylonitrile, methacrylonitrile, vinyl acetate, N-vinyl-pyrrolidone or combinations thereof. The A monomer contributes to the viscoelastic properties of the pressure-sensitive adhesive copolymer. Non-limiting examples of such A monomers include the esters of acrylic acid or methacrylic acid with a non-tertiary alcohol, such as, for example, 1-butanol, 1-pentanol, 2-pentanol, 3-pentanol, 2-methyl-1-butanol, 1-methyl-1-butanol, 1-methyl-1-pentanol, 2-methyl-1-pentanol, 3-methyl-1-pentanol, 2-ethyl-1-butanol, 2-ethyl-1-hexanol, 3,5,5-trimethyl-1-hexanol, 3-heptanol, 2-octanol, 1-decanol, 1-dodecanol and the like. Such monomeric acrylic or methacrylic acid esters are known, and many are available commercially. The B monomer is an ethylenically unsaturated compound which is copolymerized with the A monomer in order to influence the physical properties of the resulting pressure-sensitive adhesive copolymer. In general, the presence of the B monomer will reduce the flexibility of the resulting pressure-sensitive adhesive copolymer. The ratio of A monomer:B monomer in percent by weight is preferably in the range of from approximately 85:15 to approximately 98:2 and in particular from approximately 90:10 to approximately 97:3. Alternative pressure-sensitive adhesives which are suitable for the present purpose include, for example, Kraton®-based pressure-sensitive adhesives, which are obtainable as Kraton copolymers from Kraton Performance Polymers, Inc., USA.

According to a preferred embodiment of the present invention, the polymeric carrier layer is formed of a polymer selected from the group consisting of polyolefin, such as, for example, polyethylene or polypropylene, polyester, such as, for example, polyethylene terephthalate, polyamide, polystyrene, polycarbonate, polyurethane, polyvinyl acetate, ethylene vinyl acetate, ABS, polycarbonate, polyimide, acetate, epoxy polymers, polyvinyl alcohol, polyvinyl chloride, polyvinylidene chloride, polyvinylidene fluoride, polyaramid, polysulfone, polytetrafluoroethylene, copolymers or mixtures thereof, as well as elastomers.

The polymeric carrier layer is particularly preferably formed of polyethylene or polypropylene.

According to a further preferred embodiment of the present invention, the region in which the second adhesive is applied occupies from 5% to 50% (more preferably from 5% to 40%, yet more preferably from 10% to 30%, in particular from 10% to 20%) of the total area of the other side of the polymeric carrier layer, and the region in which the third adhesive is applied occupies from 95% to 50% (more preferably from 95% to 60%, yet more preferably from 90% to 70%, in particular from 90% to 80%) of the total area of the other side of the polymeric carrier layer.

According to a further preferred embodiment of the present invention, a) the second adhesive is applied in a radially inner region of the polymeric carrier layer, and the third adhesive is applied in a radially outer region of the polymeric carrier layer outwards from the radially inner region (see FIG. 3*a*)), or b) the second adhesive is applied in a radially inner region and a radially outer region of the polymeric carrier layer outwards from the radially inner region, and the third adhesive is applied to the polymeric carrier layer in a region between the radially inner region and the radially outer region (see FIG. 3*b*)), or c) the third adhesive is applied in a radially inner region of the polymeric carrier layer, and the second adhesive is applied in a radially outer region of the polymeric carrier layer outwards from the radially inner region (see FIG. 3*c*)), or d) the second adhesive is applied to the polymeric carrier layer in strips which are spaced apart and arranged radially in the manner of spokes, starting from the radial centre of the edging pad, and the third adhesive is applied to the polymeric carrier layer in the region between the strips which are spaced apart and arranged radially in the manner of spokes (see FIG. 3*d*)), or e) the second adhesive is applied to the polymeric carrier layer in strips which are spaced apart and arranged radially in the manner of spokes, starting from the radial centre of the edging pad, and in a radially outer region, and the third adhesive is applied to the polymeric carrier layer in the region between the strips which are spaced apart and arranged radially in the manner of spokes and the radially outer region (see FIG. 3*e*)), or f) the second adhesive is applied to the polymeric carrier layer in parallel strips which are spaced apart, and the third adhesive is applied to the polymeric carrier layer in the region between the spaced apart parallel strips (see FIG. 3*f*)).

It is to be noted that the present invention is not limited to the above-mentioned embodiments for the arrangement of the regions in which the second and third adhesives are applied. Rather, these embodiments are intended merely to represent examples of how the regions can be arranged, and the present invention can also be carried out with different arrangements of the regions in which the second and third adhesives are applied.

According to further preferred embodiments of the present invention, the polymeric carrier layer has a thickness in a range of from 0.1 mm to 4 mm, more preferably from 0.2 mm to 3 mm, in particular from 0.3 mm to 2 mm.

According to further preferred embodiments of the present invention, the adhesive coatings independently have a thickness of from 2 to 50 μm, more preferably from 5 to 40 μm, in particular from 10 to 30 μm.

According to further preferred embodiments of the present invention, the edging pad is circular or oval. Furthermore, the edging pad can preferably have a hole in the radial centre, which hole serves to centre the edging pad during manual application of the edging pad.

An embodiment of the present invention is described in greater detail below with reference to the drawings.

EXAMPLE

Figure 1:
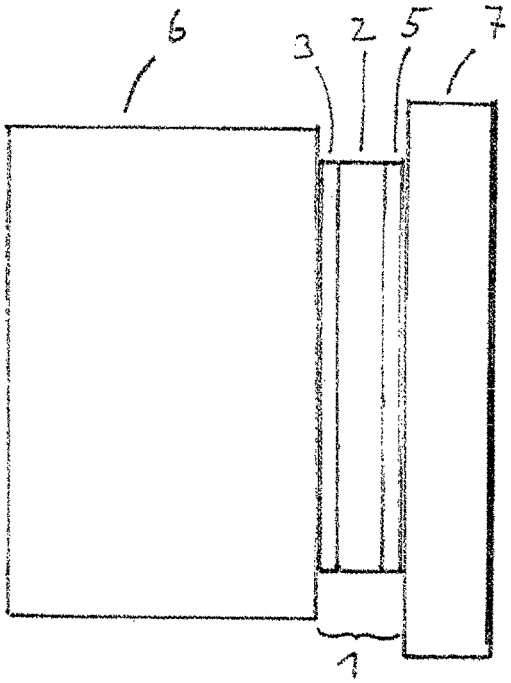
FIG. 1 is a cross-sectional view of an example of an edging pad together with a blocker element and a coated optical lens, which are connected thereto.

FIG. 1 is a cross-sectional view of an example of an edging pad 1 together with a blocker element 6, as an example of a holder, and an optical lens 7, coated in the above-mentioned manner, as an example of a material blank that is to be edged, which are releasably connected to the edging pad 1.

Figure 2:
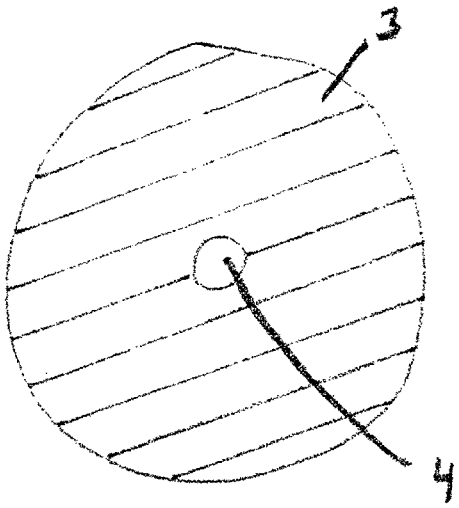
FIG. 2 is a top view of the adhesive coating of an example of an edging pad, which coating serves to connect the edging pad to a blocker element, and FIGS. 3*a*) to *f*) are top views of different embodiments of adhesive coatings (in particular of different examples of the arrangement of the second adhesive and the third adhesive) of the example of an edging pad of FIG. 2, which adhesive coatings are used for connection to an optical lens.

As can be seen in FIG. 1, the blocker element 6 is attached to the edging pad 1 by the adhesive coating 3. Since the blocker element 6 is produced from a plastics material which is conventional for this purpose and does not make any particular demands of the adhesive, there can be used for the adhesive in the adhesive coating 3 an adhesive which is conventional for this purpose and which can expediently be selected by the person skilled in the art. According to FIG. 2, the adhesive coating 3 is applied to the entire surface of one side of the polymeric carrier layer 2, so that the largest possible contact surface with the blocker element 6 is produced and the greatest possible adhesion is thus achieved. However, depending on the adhesive used for the adhesive coating 3, it is also conceivable to coat only a portion of one side of the polymeric carrier layer 2 with the adhesive, for example in the form of scattered dots or spots or strips of adhesive.

Figure 3:
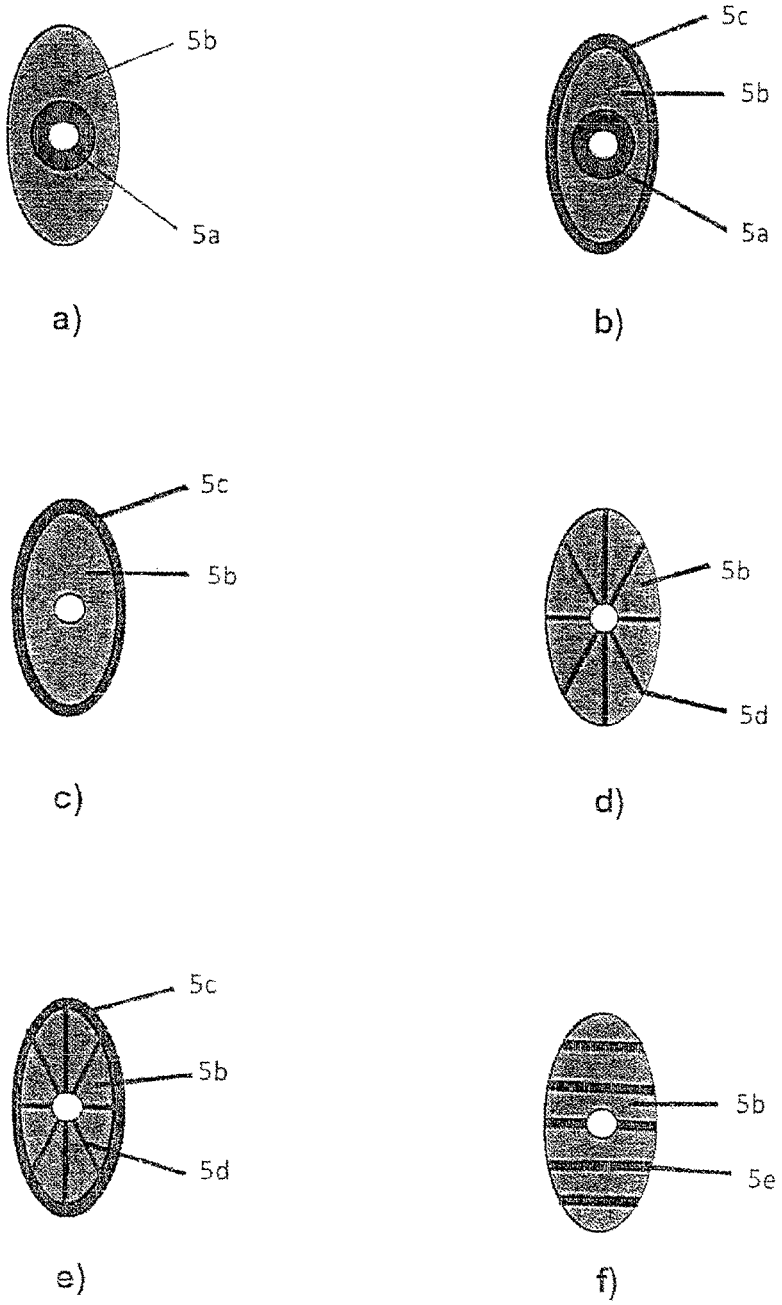

The optical lens 7 is also attached to the edging pad 1 by the adhesive coating 5. According to FIG. 3*a*), the radially inner region 5*a* and the radially outer region 5*b* of the adhesive coating 5 are by way of example in the form of concentric rings, a hole 4 being formed in the radial centre of the edging pad 1.

The radially inner region 5*a* is provided with an adhesive which has particularly good adhesiveness to the coated optical lens 7. The radially outer region 5*b*, on the other hand, is coated with an adhesive which is optimized in terms of preventing twisting of the coated optical lens 7 so that, in combination, both excellent adhesion of the coated optical lens 7 is obtained and twisting thereof is largely limited or even prevented completely.

The combination shown in FIG. 1 of edging pad 1, blocker element 6 and optical lens 7 was inserted into an E.3 edging device from Weco, and an edge grinding operation was carried out. It was found that the coated optical lens 7 adhered to the edging pad 1 in such a manner that, in addition to excellent adhesion, no problems at all occurred with regard to twisting of the optical lens 7 on the edging pad 1.

The novel configuration of adhesives on the material blank side of the edging pad thus eliminates the problems of edging pads of the prior art with regard to twisting of the material blank that is to be edged during the edging operation.

LIST OF REFERENCE NUMERALS

1 Edging pad
2 Polymeric carrier layer
3 Adhesive coating
4 Hole
5 Adhesive coating
5*a*, 5*c*, 5*d*, 5*e* Region in which the second adhesive is applied
5*b* Region in which the third adhesive is applied
6 Holder or blocker element
7 Material blank or optical lens

The invention claimed is:

1. An edging pad for releasably connecting a material blank that is to be edged to a holder, wherein the edging pad has a polymeric carrier layer and adhesive coatings which are applied to both sides of the polymeric carrier layer, wherein one side of the polymeric carrier layer, which is to be connected to the holder, has an adhesive coating formed of a first adhesive, and the other side of the polymeric carrier layer, which is to be connected to the material blank, has an adhesive coating formed of a second and a third adhesive which are different from one another, such that the second adhesive provides adhesiveness to the material blank and the third adhesive is an adhesive which limits twisting or slippage of the polymeric carrier layer relative to the material blank, wherein the second adhesive and the third adhesive are applied to the other side of the polymeric carrier layer in separate regions.

2. The edging pad according to claim 1, in which the polymeric carrier layer is formed of a polymer selected from the group consisting of polyolefin, polyester, polyamide, polystyrene, polycarbonate, polyurethane, polyvinyl acetate, ethylene vinyl acetate, ABS, polycarbonate, polyimide, acetate, epoxy polymers, polyvinyl alcohol, polyvinyl chloride, polyvinylidene chloride, polyvinylidene fluoride, polyaramid, polysulfone, polytetrafluoroethylene, copolymers or mixtures thereof, as well as elastomers.

3. The edging pad according to claim 1, in which the first, the second and the third adhesives are selected independently from pressure-sensitive copolymer adhesives which are reaction products of the polymerization of at least one A monomer and at least one B monomer, wherein the A monomer is a polymerizable monomer which comprises an acrylate or methacrylate ester of a non-tertiary alcohol or of a mixture of non-tertiary alcohols, and the B monomer is an ethylenically unsaturated compound.

4. The edging pad according to one of claim 1, in which the region in which the second adhesive is applied occupies from 5% to 50% of the total area of the other side of the polymeric carrier layer, and the region in which the third adhesive is applied occupies from 95% to 50% of the total area of the other side of the polymeric carrier layer.

5. The edging pad according to one of claim 1, in which the region in which the second adhesive is applied occupies from 5% to 40% of the total area of the other side of the polymeric carrier layer, and the region in which the third adhesive is applied occupies from 95% to 60% of the total area of the other side of the polymeric carrier layer.

6. The edging pad according to one of claim 1, in which the region in which the second adhesive is applied occupies from 10% to 30% of the total area of the other side of the polymeric carrier layer, and the region in which the third adhesive is applied occupies from 90% to 70% of the total area of the other side of the polymeric carrier layer.

7. The edging pad according to one of claim 1, in which the region in which the second adhesive is applied occupies from 10% to 20% of the total area of the other side of the polymeric carrier layer, and the region in which the third adhesive is applied occupies from 90% to 80% of the total area of the other side of the polymeric carrier layer.

8. The edging pad according to one of claim 1, in which a) the second adhesive is applied in a radially inner region of the polymeric carrier layer, and the third adhesive is applied in a radially outer region of the polymeric carrier layer outwards from the radially inner region, or b) the second adhesive is applied in a radially inner region and a radially outer region of the polymeric carrier layer outwards from the radially inner region, and the third adhesive is applied to the polymeric carrier layer in a region between the radially inner region and the radially outer region, or c) the third adhesive is applied in a radially inner region of the polymeric carrier layer, and the second adhesive is applied in a radially outer region of the polymeric carrier layer outwards from the radially inner region, or d) the second adhesive is applied to the polymeric carrier layer in strips which are spaced apart and arranged radially in the manner of spokes, starting from the radial center of the edging pad, and the third adhesive is applied to the polymeric carrier layer in the region between the strips which are spaced apart and arranged radially in the manner of spokes, or e) the second adhesive is applied to the polymeric carrier layer in strips which are spaced apart and arranged radially in the manner of spokes, starting from the radial center of the edging pad, and in a radially outer region, and the third adhesive is applied to the polymeric carrier layer in the region between the strips which are spaced apart and arranged radially in the manner of spokes and the radially outer region, or f) the second adhesive is applied to the polymeric carrier layer in parallel strips which are spaced apart, and the third adhesive is applied to the polymeric carrier layer in the region between the spaced apart parallel strips.

9. The edging pad according to one of claim 1, in which the polymeric carrier layer has a thickness in a range of from 0.1 mm to 4 mm.

10. The edging pad according to one of claim 1, in which the adhesive coatings independently have a thickness of from 2 to 50 μm.

11. The edging pad according to one of claim 1, wherein the edging pad is circular or oval.

12. The edging pad according to one of claim 1, wherein the edging pad has a hole in the radial center.

* * * * *